US007542005B2

(12) United States Patent
Mohamadi

(10) Patent No.: US 7,542,005 B2
(45) Date of Patent: Jun. 2, 2009

(54) TUNABLE INTEGRATED ANTENNA

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 356 days.

(21) Appl. No.: 11/567,650

(22) Filed: Dec. 6, 2006

(65) Prior Publication Data

US 2007/0097010 A1 May 3, 2007

(51) Int. Cl.
*H01Q 21/00* (2006.01)

(52) U.S. Cl. ..... 343/853; 343/795

(58) Field of Classification Search ..... 343/700 MS, 343/795, 850, 853
See application file for complete search history.

(56) References Cited

U.S. PATENT DOCUMENTS

| | | | | |
|---|---|---|---|---|
| 6,963,307 | B2 * | 11/2005 | Mohamadi | 343/700 MS |
| 7,286,804 | B2 * | 10/2007 | Miyagi et al. | 455/169.1 |
| 7,312,763 | B2 * | 12/2007 | Mohamadi | 343/853 |
| 6,982,670 | B2 | 1/2008 | Farrokh | |
| 7,321,339 | B2 * | 1/2008 | Mohamadi | 343/853 |
| 2007/0018903 | A1 * | 1/2007 | Mohamadi | 343/853 |
| 2007/0146207 | A1 * | 6/2007 | Mohamadi | 343/700 MS |
| 2007/0194991 | A1 * | 8/2007 | Mohamadi | 343/700 MS |
| 2007/0290930 | A1 * | 12/2007 | Krishnaswamy et al. | 343/700 MS |
| 2008/0079636 | A1 * | 4/2008 | Mohamadi | 343/700 MS |
| 2008/0252546 | A1 * | 10/2008 | Mohamadi | 343/853 |
| 2008/0297414 | A1 * | 12/2008 | Krishnaswamy et al. | 342/368 |

OTHER PUBLICATIONS

Farrokh Mohamadi, A proposed completely electronically controlled beamforming technology for coverage enhancement, IEEE P802.15, Mar. 2005, Atlanta, GA.

C. Goldsmit, T.H. Lin, B. Powers, W.R. Wu, and B. Norvell, Micromechanical Membrane Switches For Microwave Applications, IEEE MTT-S Dig., 1995, pp. 91-94.

A. Malczewski, S. Eshelman, B. Pillans, J. Ehmke, and C. L. Goldsmith, X-band RF MEMS Phase Shifters for Phased Array Applications, Dec. 1999, pp. 517-519, vol. 9.

J. Hayden and G. Rebeiz, Very Low-Loss Distributed X-Band and Ka-band MEMS Phase Shifters Using Meta-Air-Metal Capacitors, Jan. 2003, vol. 41, No. 1.

* cited by examiner

*Primary Examiner*—Tan Ho
(74) *Attorney, Agent, or Firm*—Haynes & Boone, LLP.

(57) ABSTRACT

In accordance with an embodiment, an integrated circuit is provided that includes a substrate, a plurality of dipoles adjacent the substrate; an RF feed network adjacent the substrate and coupled to drive a plurality of output nodes with an RF signal; and a plurality of tuning circuits corresponding to the plurality of dipoles, each tuning circuit configured to load an RF signal from a corresponding one of the output nodes with a variable capacitance responsive to a control signal, the loaded RF signal driving the dipole antenna corresponding to the tuning circuit.

15 Claims, 11 Drawing Sheets

TUNABLE INTEGRATED ANTENNA

TECHNICAL FIELD

The disclosure relates generally to integrated circuits and more particularly to an integrated tunable antenna.

BACKGROUND

Conventional high-frequency antennas are often cumbersome to manufacture. For example, antennas designed for 100 GHz bandwidths typically use machined waveguides as feed structures, requiring expensive micro-machining and hand-tuning. Not only are these structures difficult and expensive to manufacture, they are also incompatible with integration to standard semiconductor processes.

As is the case with individual conventional high-frequency antennas, beamforming arrays of such antennas are also generally difficult and expensive to manufacture. Conventional beamforming arrays require complicated feed structures and phase-shifters that are impractical to be implemented in a semiconductor-based design due to its cost, power consumption and deficiency in electrical characteristics such as insertion loss and quantization noise levels. In addition, conventional beamforming arrays become incompatible with digital signal processing techniques as the operating frequency is increased. For example, at the higher data rates enabled by high frequency operation, multipath fading and cross-interference becomes a serious issue. Adaptive beamforming techniques are known to combat these problems. But adaptive beamforming for transmission at 10 GHz or higher frequencies requires massively parallel utilization of A/D and D/A converters.

Accordingly, there is need in the art for integrated antenna systems with automated tuning. In addition, there is a need in the art for integrated antennas systems with automated tuning and beamforming capabilities.

SUMMARY

In accordance with an embodiment, an integrated circuit is provided that includes a substrate, a plurality of dipoles adjacent the substrate; an RF feed network adjacent the substrate and coupled to drive a plurality of output nodes with an RF signal; and a plurality of tuning circuits corresponding to the plurality of dipoles, each tuning circuit configured to load an RF signal from a corresponding one of the output nodes with a variable capacitance responsive to a control signal, the loaded RF signal driving the dipole antenna corresponding to the tuning circuit.

In accordance with another embodiment, a method is provided that includes: driving a resonant network of distributed oscillators to produce an globally synchronized output signal at a plurality of output nodes; loading the plurality of output nodes with a variable capacitance to match the resonant network to a corresponding plurality of dipole antennas; and transmitting the globally synchronized output signal from the plurality of loaded output nodes through the corresponding plurality of dipole antennas.

In accordance with another embodiment, an integrated circuit is provided that includes: a substrate, a plurality of dipole antennas adjacent a first side of the substrate; and an RF feed network adjacent a second side of the substrate, the RF feed network coupling to a distributed plurality of amplifiers integrated with the substrate, wherein the RF feed network and the distributed plurality of amplifiers are configured to form a resonant network such that if a timing signal is injected into an input port of the RF feed network, the resonant network oscillates to provide a globally synchronized RF signal to a plurality of integrated antenna circuits, wherein each integrated antenna circuit includes a corresponding subset of dipole antennas, and wherein each integrated antenna circuit includes a phase shifter to phase shift the globally synchronized RF signal to provide a phase-shifted signal to a tuning circuit that in turn provides a loaded signal to the integrated antenna circuit's dipole antenna, the tuning circuit loading the loaded signal with a variable capacitance The invention will be more fully understood upon consideration of the following detailed description, taken together with the accompanying drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
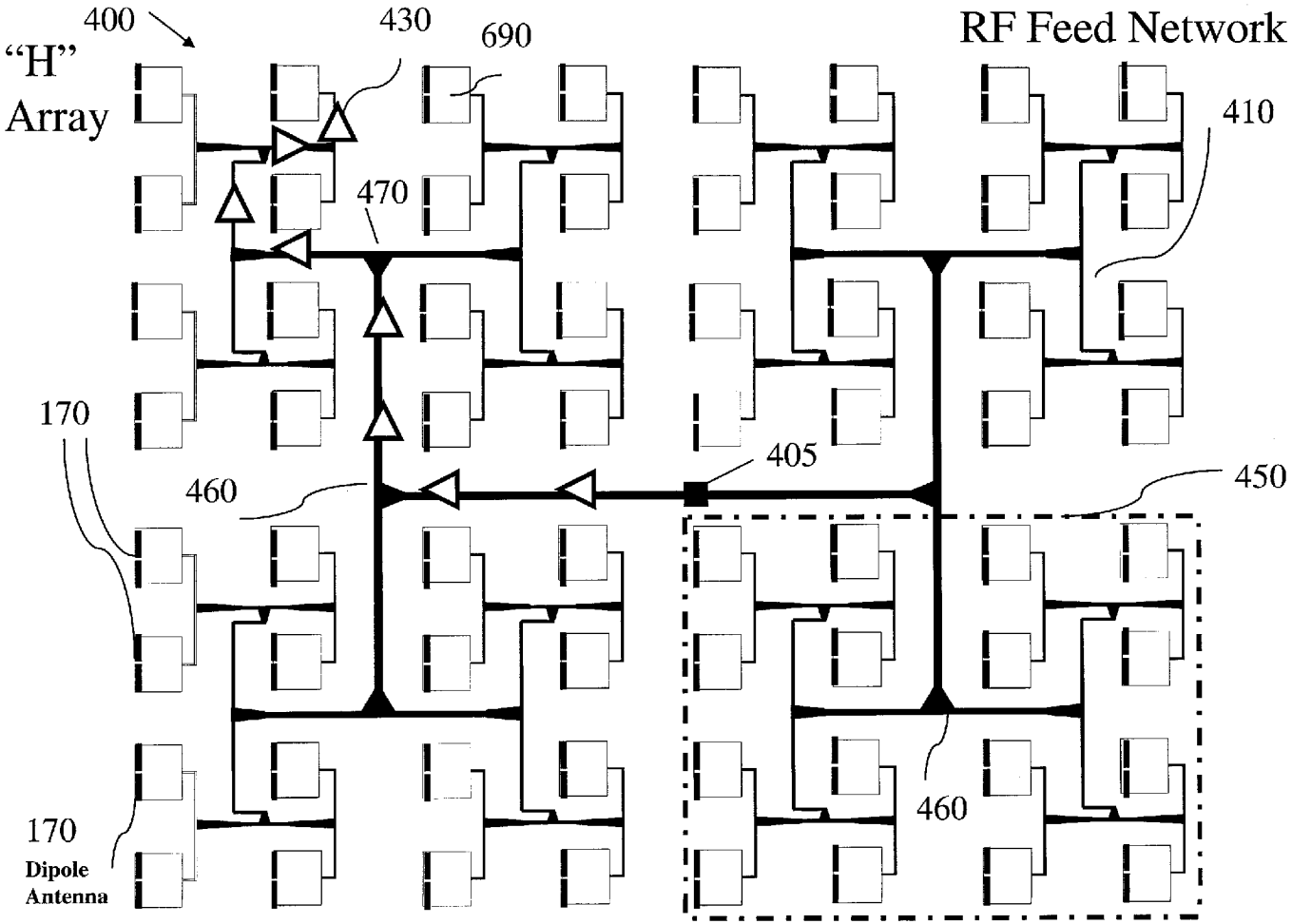
FIG. 1 is an illustration of a wafer scale resonant transmitting network.

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

An integrated circuit is disclosed that comprises active circuitry in a semiconductor substrate configured to drives one or more dipole antennas formed in semiconductor processing metal layers overlaying the substrate. Because an array of antennas enables beamforming applications, the following discussion will assume without limitation that a plurality of antennas is provided. A transmission network couples signals between the antennas and baseband and/or IF processing stages. A variety of transmission networks may be used such as such as co-planar waveguide (CPW), microstrip, and planar waveguides. CPW enjoys superior shielding properties over microstrip. Thus, the following discussion will assume without loss of generality that the transmission network is implemented using CPW.

In a transmit mode, RF signals are driven into an input port of the transmission network and propagated to the antennas. As will be explained further herein, each antenna includes a tuning circuit so as to resonantly match the transmission network. In that regard, a dipole antenna presents a largely inductive load to the transmission network. In one embodiment, each tuning circuit comprises one or more varactors that adds a capacitance to its dipole so as to present a resonant LC load to the network. Similarly, in a receive mode, RF signals from the antennas are propagated through the transmission network to an output port. Regardless of the propagation direction (transmit or receive), the RF propagation across a CPW network on a semiconductor wafer such as an 8" wafer may introduce losses as high as 120 dB. To counteract such losses, a plurality of distributed amplifiers may be coupled to the CPW network such as disclosed in U.S. application Ser. No. 11/454,915, filed Jun. 16, 2006, the contents of which are incorporated by reference. For example, a first linear transistor amplifier (which may be denoted as a driving amplifier) amplifies a received RF signal through a length of the CPW network into a second linear transistor amplifier (which may be denoted as a matching amplifier) configured to match its output impedance to the characteristic impedance of the CPW network. Both the gain of the driving amplifier and the gain and the output impedance of the matching amplifier are tuned using reactive loads such as integrated inductors. In this fashion, resistive losses are minimized. These gains may be maintained so that linear operation is achieved. In this fashion, an RF signal driven into an input port of the CPW network is linearly amplified and propagated to the integrated antenna circuits, despite the transmission line losses.

Although a linear amplification scheme using distributed amplifiers overcomes the transmission line losses, the CPW network introduces dispersion in wideband pulses. To avoid this dispersion, embodiments of the disclosed tunable dipoles use the distributed oscillator architecture disclosed in U.S. application. Ser. No. 11/555,210, filed Oct. 31, 2006, the contents of which are incorporated by reference. In this fashion, a wafer scale (integrated with a semiconductor wafer) dipole antenna system is enabled in which a resonant transmission network with distributed amplification is driven by a triggering pulse waveform such that the entire transmission network oscillates acting as a distributed oscillator. Advantageously, the RF signal from the resulting distributed oscillator thereby arrives synchronously at the plurality of dipole antennas.

Turning now to FIG. 1, a resonant half-duplex transmission network 410 for an 8×8 sub-array of dipole antenna elements 170 is implemented in an wafer substrate such as an 8" wafer scale radar module 400. The triggering signal to trigger the resonant oscillation is injected into a center feed point 405. Distributed amplifiers 430 coupled to the network then injection lock to each other such that each antenna 170 may receive a globally synchronized RF signal. The transmission network may be single-ended or differential. In one embodiment, the network may comprise a coplanar waveguide (CPW) having a conductor width of a few microns (e.g., 4 microns). With such a small width or pitch to the network, an array of antenna elements may be readily networked in an 8 inch wafer substrate for, for example, 60 GHz operation.

Figure 2:
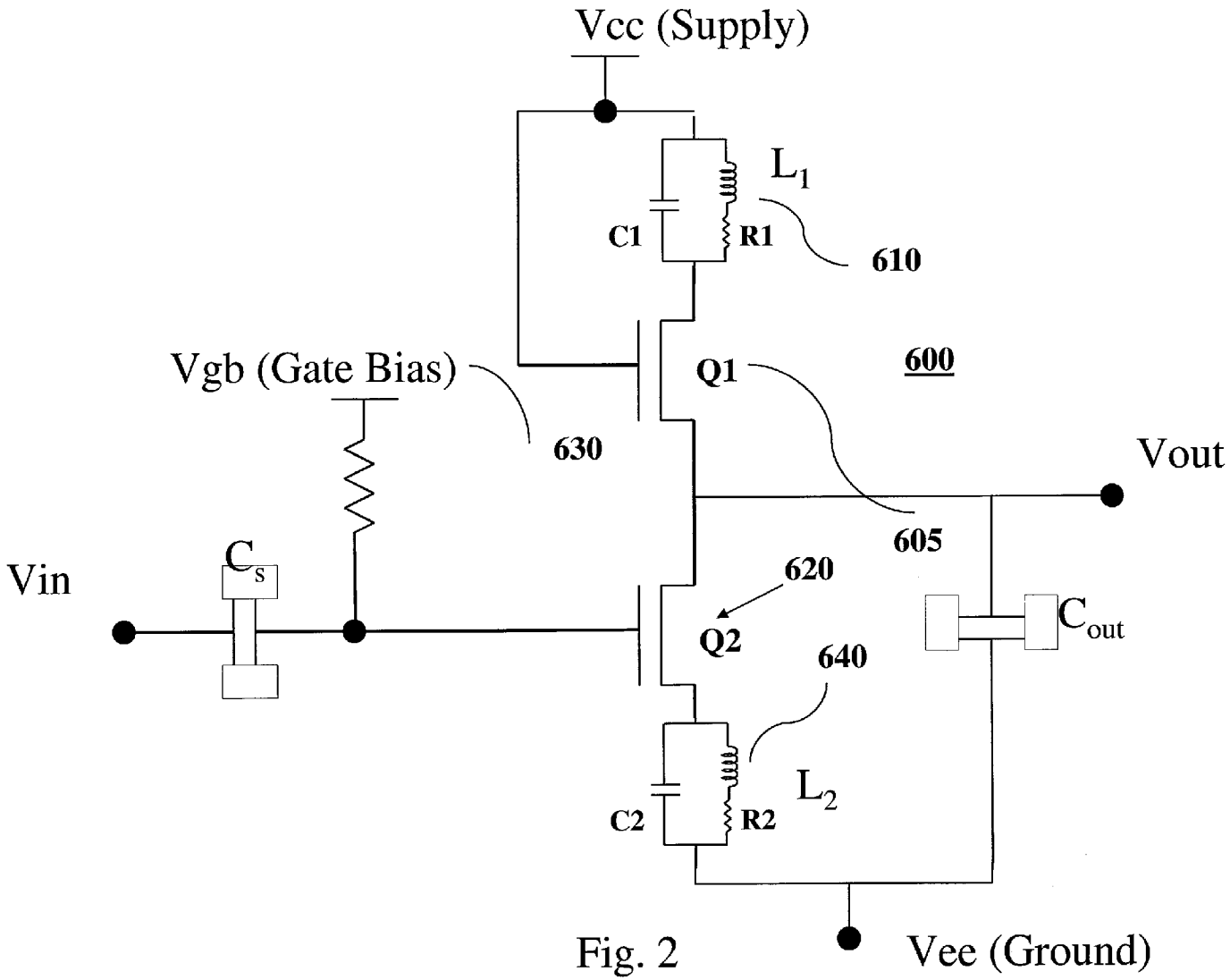
FIG. 2 is a schematic illustration of a matching amplifier for the resonant transmitting network of FIG. 1.

The design of the distributed amplifiers is not critical so long as they provide sufficient amplification and achieve a resonant operation with the transmission network. Thus, it will be appreciated that the distributed amplifiers may comprise the driving/matching amplifiers discussed below or alternative distributed amplifiers may be used. In one embodiment, a driving amplifier in the transmission network is followed by a matching amplifier for efficient performance. An exemplary embodiment of a FET-based matching amplifier 600 is illustrated in FIG. 2. Matching amplifier 600 couples to a coplanar waveguide network (not illustrated) at input port Vin and output port Vout. An analogous BJT-based architecture may also be implemented. The FETs may be either NMOS or PMOS. A first NMOS FET Q1 605 has its drain coupled through an integrated inductor (L1) 610 to a supply voltage Vcc. This integrated inductor L1 may be formed using metal layers in a semiconductor manufacturing process as discussed in commonly-assigned U.S. Pat. No. 6,963,307, the contents of which are incorporated by reference. Because such an integrated inductor L1 will also have a stray capacitance and resistance, these stray effects are modeled by capacitor C1 and resistor R1. The metal layers in the semiconductor process may also be used to form a DC blocking capacitor $C_s$ and an output capacitor $C_{out}$. The supply voltage also biases the gate of Q1. Q1 has its drain driving Vout and its source coupled to a second NMOS FET Q2 620. A voltage source 630 coupled through a high value resistor or configured transistor biases the gate of Q2 620 with a voltage Vgb (whereas in a BJT embodiment, the base of Q1 is biased by a corresponding current source). The source of Q2 620 couples to ground through an integrated inductor (L2) 640. Analogous to inductor 610, inductor 640 has its stray capacitance and resistance modeled by capacitor C2 and resistor R2. It may be shown that an input resistance Rin for amplifier 600 is as follows:

$$Rin=(gm)*L2/Cgs$$

where gm is the transconductance for Q2 620, L2 is the inductance of the inductor 640 and Cgs is the gate-source capacitance for Q2 620. Thus, Q2 620 and inductor 640 characterize the input impedance and may be readily designed to present a desired input impedance. For example, if an input resistance of 50 Ω is desired (to match a corresponding impedance of the CPW network), the channel dimensions for Q2 and dimensions for inductor 640 may be designed accordingly. The gain of matching amplifier 600 is proportional to the inductance of L1.

Figure 3:
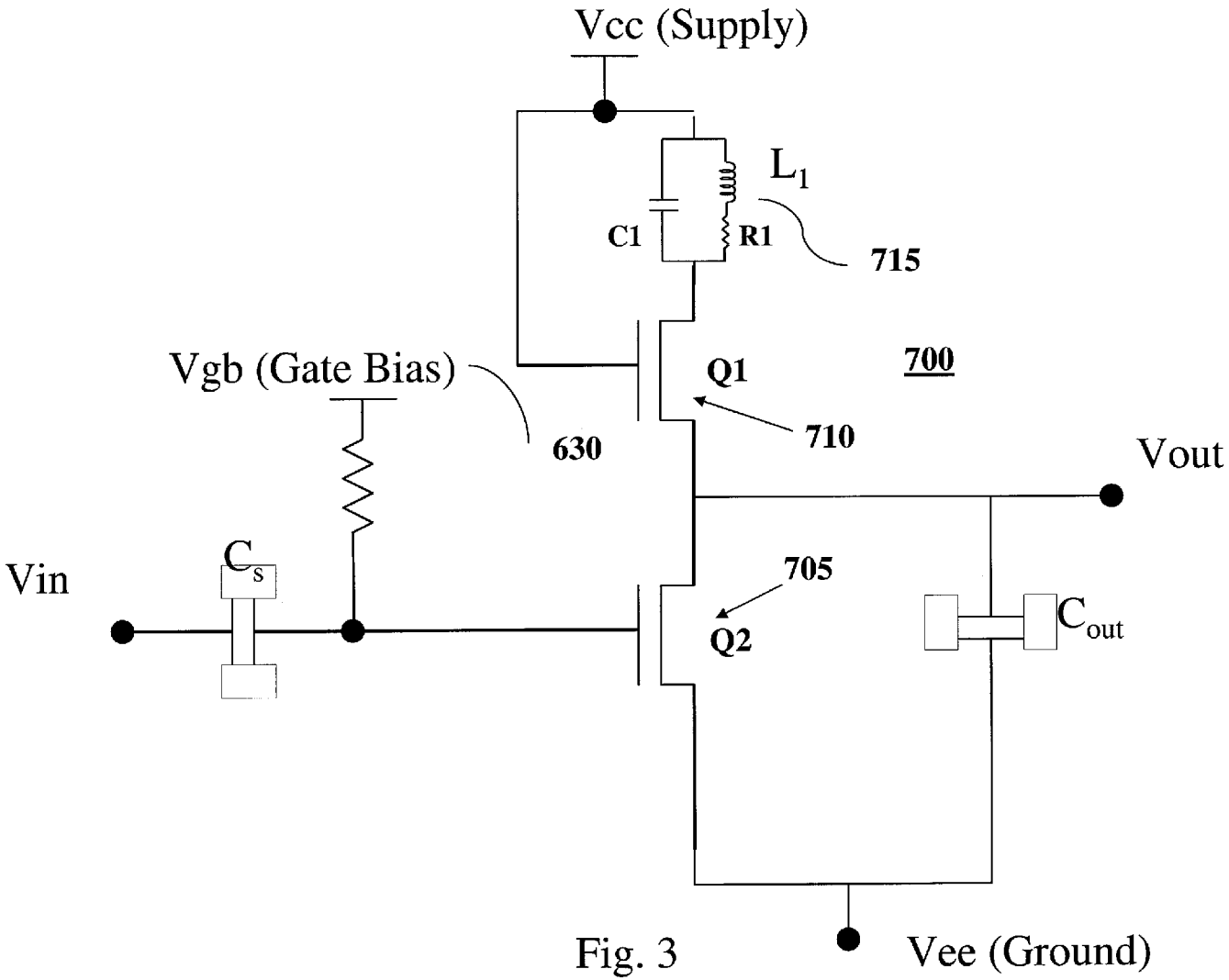
FIG. 3 is a schematic illustration of a driving amplifier for the resonant transmitting network of FIG. 2.

An exemplary driving amplifier 700 is illustrated in FIG. 3. Driving amplifier 700 is constructed analogously to matching amplifier 600 except that no inductor loads the source of Q2 705 (alternatively, an inductor having a fraction to 1/10 the inductance of L1 may load the source of Q2). The gain of driving amplifier 700 is proportional to the inductance of L1. A transistor Q1 710 has its drain loaded with integrated inductor L1 715 in a similar fashion as discussed with regard to Q1 605 of matching amplifier 600. Inductor 715 determines a center frequency Fd for driving amplifier 700 whereas both inductors 640 and 610 establish a resonant frequency Fm for matching amplifier 600. It may be shown that the band-pass center frequency Fc of a series-connected driving and matching amplifier is given as $$Fc = 1/2*sqrt(Fd^2 + Fm^2)$$

Referring back to FIG. 1, a series of driving amplifier/matching amplifier pairs 430 are shown coupling feed point 405 to a first network intersection 460. In such an "H" configured network array, network 410 will continue to branch from intersection 460 such as at an intersection 470. For illustration clarity, the distribution of the driving amplifier/matching amplifier pairs 430 is shown only in selected transmission paths in FIG. 1. It will be appreciated that both the driving amplifiers and the matching amplifiers may be constructed using alternative arrangements of bipolar transistors such as PNP bipolar transistors or NPN bipolar transistors. In a bipolar embodiment, biasing voltage sources 630 are replaced by biasing current sources. In addition, the RF feed network and these amplifiers may be constructed in either a single ended or differential fashion. DC and control lines may be arranged orthogonally to the RF distribution direction for isolation.

Figure 4:
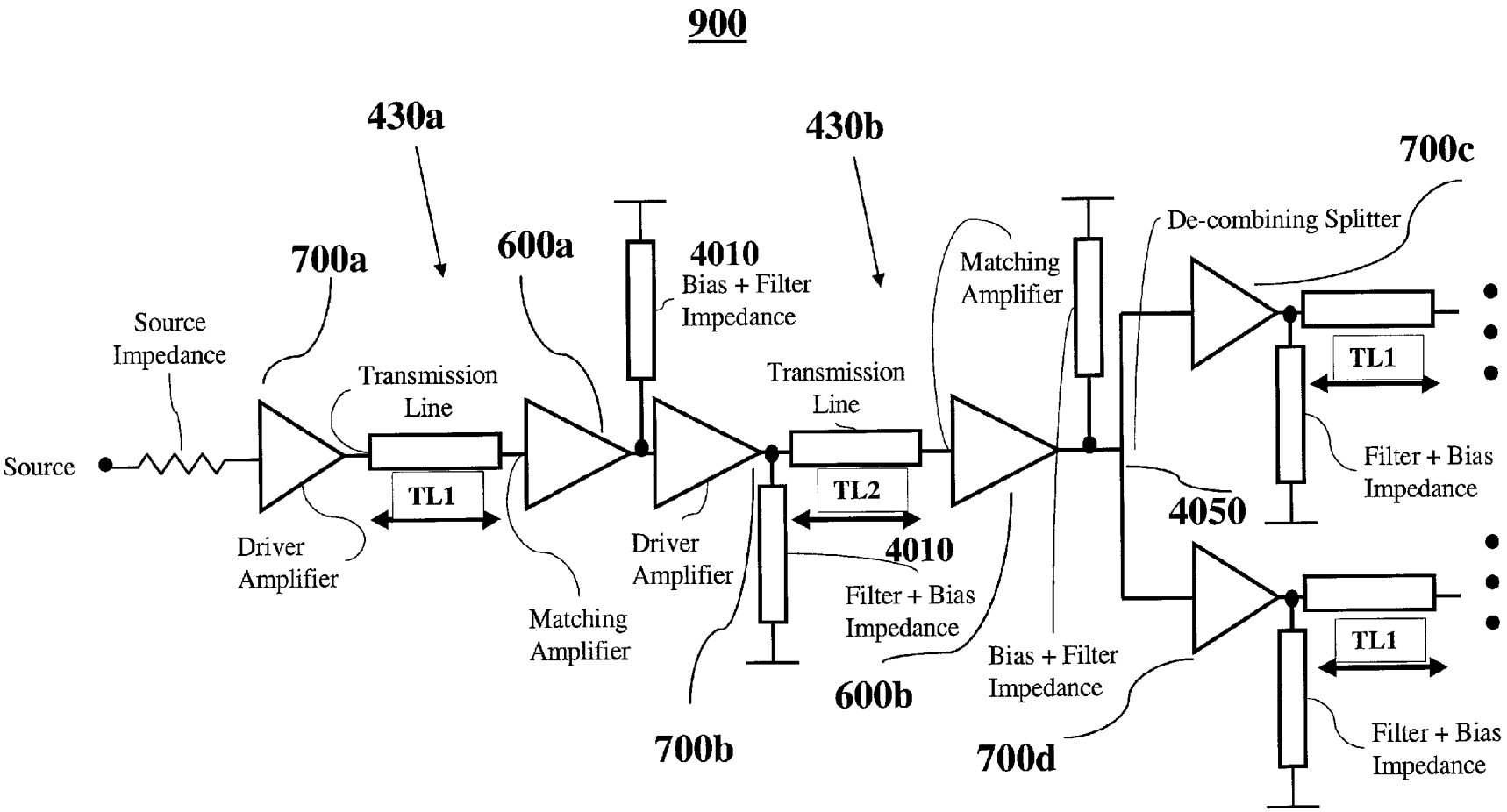
FIG. 4 illustrates a section of the resonant transmitting network of FIG. 1.

The resonant network properties are influenced by the distance between driving amplifiers and matching amplifiers in successive driving amplifier/matching amplifier pairs. For example, as seen for RF network portion 900 in FIG. 4, its input or source is received at a first driver amplifier 700 a, which drives a matching amplifier 600*a* separated from driver 700*a* by a length of network transmission line (such as coplanar waveguide) of length TL1. Driver amplifier 700*a* and matching amplifier 600*a* thus constitute a first driving amplifier/matching amplifier pair 430*a*, which may also be denoted as a load balanced amplifier (LBA). Matching amplifier 600*a* is immediately followed by a driver amplifier 700*b*, which couples to the output of matching amplifier 600*a* directly in the active circuitry semiconductor substrate rather than through a transmission line section. In this fashion, die space on the wafer substrate is conserved. However, it will be appreciated that an RF network CPW transmission line segment could also be used to couple matching amplifier 600*a* to driving amplifier 700*b*. Driver amplifier 700*b* drives a matching amplifier 600*b* separated from driver 700*b* by a length TL2 of network transmission line. Driver amplifier 700*b* and matching amplifier 600*b* thus form a second driving amplifier/matching amplifier 430*b*. The necessary biasing and inductance loading as described with respect to FIGS. 2 and 3 are represented by bias and filter impedances 4010. In general, the sum of TL1 and TL2 should equal one half of the center frequency wavelength. By changing the ratio of TL1/TL2 and the output capacitance, a maximum stable gain of approximately 20 to 30 dB may be obtained for 10 GHz to, for example, 40 GHz operation. In a linear amplification (as opposed to resonant operation) 10 GHz embodiment, stable gain and frequency performance may be realized for a capacitance load of 50 fF as TL1/TL2 is varied from 40% to 80%.

It is claimed that the resonant frequency of the resonant transmission network illustrated in FIG. 1 depends on the number of the distributed amplifiers (entire length of transmission line) from central triggering point 405 reaching to each antenna 170. For example, the resonant oscillation may be achieved for a 128 quarter wavelength transmission distance from point 405 to each antenna 170 with TL1=400 micron and TL2=1250 micron, a Q1 current sink ability of 15× that of Q2 (in both driver and matching amplifier) with 2× source ability and a triggering pulse width of 20 pS and repetition rate of 3600 pS produces a steady state oscillation of 600 mV and frequency of 20 GHz at the termination point for appropriate values of the resonant loads. Advantageously, such 20 GHz distribution need may consume only 30 mV across the wafer. Changing the pulse triggering repetition to 400 pS and reducing the load to 3× and the sink to 3× with regard to the minimum geometry for the Q1 and Q2 transistors yields a 33 GHz oscillation frequency. Further reduction of transistor Q1 to 1× and Q2 to 1× results in a frequency of oscillation close to 45 GHz. In general, as the number of distributed amplifiers in increased in the resonant network, the resonant oscillation period will increase due to the parasitics from the increased number of components.

A variety of dipole antennas may be used such as the T-shaped dipoles described in U.S. Pat. No. 6,963,307. Regardless of the particular topology, each dipole may be constructed in the metal layers of the semiconductor process used on the substrate analogously as discussed with regard to the transmission network. In one embodiment, the CPW network may be formed on the "back" side of the substrate whereas the dipoles would be formed on the opposing side of the substrate. This approach is analogous to that discussed in U.S. application Ser. No. 11/454,915. This backside approach may be better understood by classifying a wafer scale antenna module (WSAM) into three layers. The first layer would be a semiconductor substrate, such as silicon. On a first surface of the substrate, antennas such as the T-shaped dipoles of U.S. Pat. No. 6,963,307 are formed in the overlaying semiconductor metal layers. Active circuitry for the corresponding resonant transmission network that drives these antennas is formed on a second opposing surface of the substrate. The CPW transmission network is formed adjacent this second opposing surface in corresponding semiconductor processing metal layers. The second layer would include the antennas on the first side of the substrate whereas the third layer would include the CPW network. It may be seen why such an approach is deemed a "backside" architecture in that the active circuitry and the antennas are separated on either side of the substrate. In this fashion, electrical isolation between the active circuitry and the antenna elements is enhanced. Moreover, the ability to couple signals to and from the active circuitry is also enhanced. As discussed analogously in U.S. application Ser. No. 10/942,383, filed Sep. 14, 2004, the contents of which are incorporated by reference, a heavily doped deep conductive junction through the substrate couples the active circuitry to contacts that couple to the metal-layer-formed antennas. Formation of the junctions is similar to a deep diffusion junction process used for the manufacturing of double diffused CMOS (DMOS) or high voltage devices. It provides a region of low resistive signal path to minimize insertion loss to the antenna elements.

Upon formation of the junctions in the substrate, the active circuitry may be formed using standard semiconductor processes. The active circuitry may then be passivated by applying a low temperature deposited porous SiOx and a thin layer of nitridized oxide ($Si_xO_yN_z$) as a final layer of passivation. The thickness of these sealing layers may range from a fraction of a micron to a few microns. The opposing second surface may then be coated with a thermally conductive material and taped to a plastic adhesive holder to flip the substrate to expose the first surface. The substrate may then be back ground to reduce its thickness to a few hundreds of micrometers. An electric shield may then be sputtered or alternatively coated using conductive paints on background surface.

In an alternative embodiment, the CPW network may be integrated on the antenna side of the substrate. It will be appreciated that either location of the CPW network has certain advantages. For example, integrating the CPW network into the same metal layers that form the antennas greatly simplifies manufacturing and thus lowers costs. A backside approach, on the other hand, has better isolation and coupling properties but requires the substrate to have metal layers formed on both sides. Because a frontside approach has the advantages of lower costs, the following discussion will assume without loss of generality that the RF feed network is integrated with the substrate on the same substrate side as the antennas.

Figure 5:
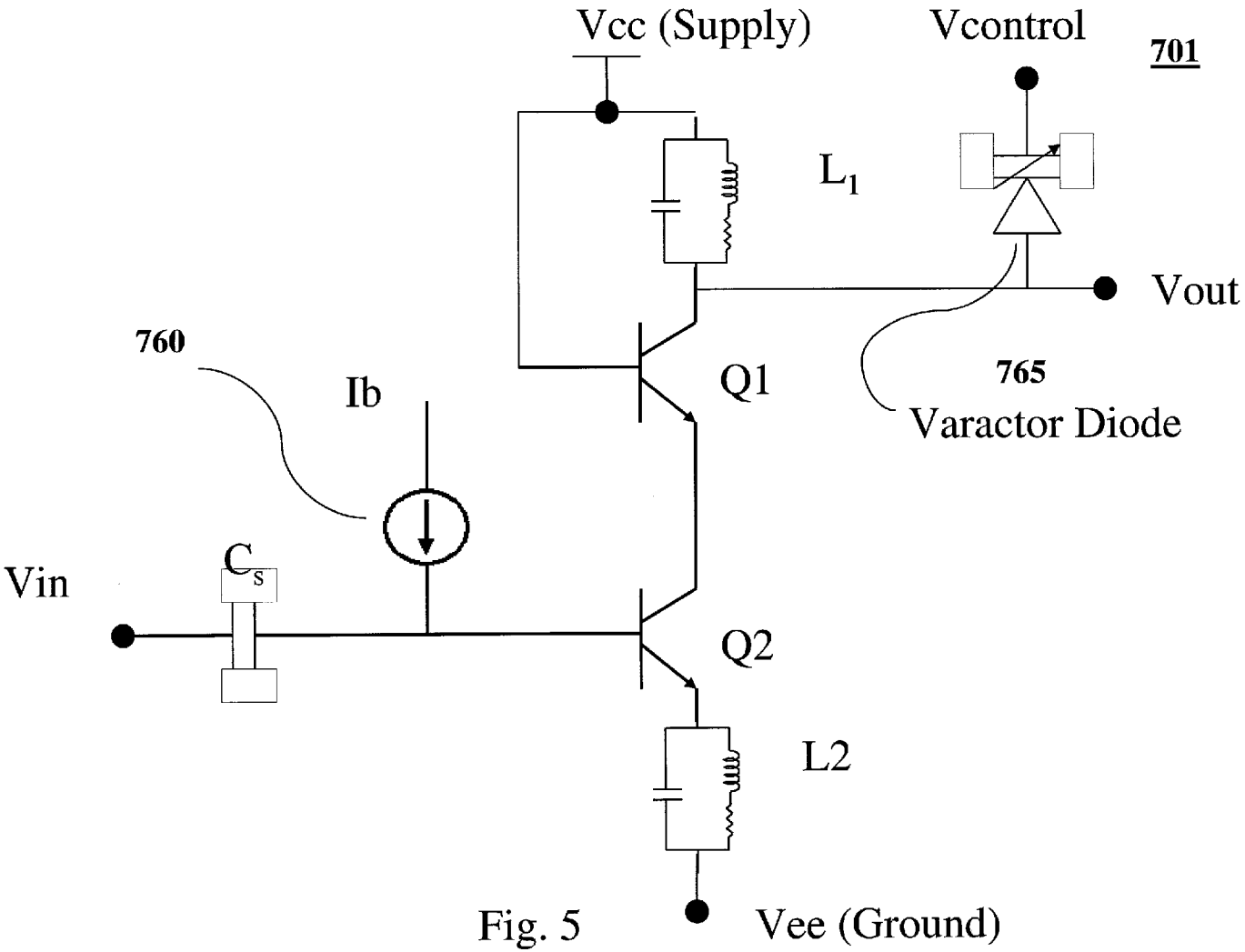
FIG. 5 is a circuit diagram of a stage for a phase-shifter.

As discussed above, a dipole antenna will present a largely inductive load to the resonant transmission network. To match this inductive load to the transmission network, each antenna may couple to the transmission network through a tuning circuit such as a varactor. In a beamforming embodiment, each antenna would also couple through a variable phase-shifter as well. In such embodiment, the combination of the phase-shifter, the tuning circuit, and the antenna may be denoted as an integrated antenna circuit. Each phase-shifter may be formed using any suitable means such as the selectable delay lines discussed in U.S. application Ser. No. 11/454,915. A particularly advantageous analog phase shift may be achieved in a phase-shifter at relatively constant gain using a variable capacitor array phase shifter (VCAPS) as follows. Each distributed VCAPS may use one or more driver amplifiers/variable capacitor stages where stage includes a modified driver amplifier. This modified driver amplifier has the output capacitor discussed with regard to FIG. 3 replaced by a varactor. A bipolar-based VCAPS stage 701 is illustrated in FIG. 5. As discussed analogously with regard to driver amplifier 700, VCAPS stage 701 includes a DC blocking capacitor $C_s$ between the base of BJT transistor Q2 and an input voltage node Vin. In addition, the base of Q2 is biased by a current source 760 that provides a bias current $I_b$. As discussed analogously with regard to matching amplifier 600, the gain of VCAPS stage 701 is proportional to the inductance of an integrated inductor L1 that loads an output node Vout. The collector of BJT Q2 couples to an emitter of a BJT Q1 whose collector couples to the loaded output node Vout. An optional integrated inductor L2 loads the emitter of BJT Q2. Typically, the inductance of L2 should be a fraction to approximately $1/10^{th}$ that of L1. Integrated inductor L2 functions to better match stage 701 so as to reduce reflected energy back through input node Vin. In addition to being loaded by the integrated inductor L1, the output node is also loaded by a varactor diode 765. Each varactor diode may be implemented using a PIN diode, n+/p−, or p+/n−, or MOS variable capacitor. A control voltage Vcontrol controls the capacitance of the varactor diode.

VCAPS stage 701 takes advantage of the following remarkable phase and gain variation discussed in U.S. application Ser. No. 11/535,928. In particular, the variation of phase shift and gain between input node Vin and output node Vout of VCAPS stage 701 may be configured such that the gain is relatively constant yet the phase change is pronounced as the capacitance of the varactor diode is changed. By changing the bias current Ib and the inductance of L1 appropriately, it will be appreciated that such a "pivot point" maximal-phase-shift-yet-constant-gain performance may achieved for any desired frequency. A CMOS FET-based embodiment may be derived from stage 701 by replacing the bipolar transistors with corresponding FETs. Referring back to FIG. 3, the gate of Q1 would then be driven with a bias voltage instead of a bias current. Regardless of whether stage 701 is implemented using FETs or bipolar transistors, its output phase shift is adjusted through the Vcontrol voltage. As this voltage is changed, the varactor capacitance is changed. The greater the varactor capacitance, the greater will be the load on the amplifier. Thus, the bias signal (current or voltage depending upon whether stage 701 is bipolar or FET-based) may be adjusted to compensate for this varying load.

Figure 6:
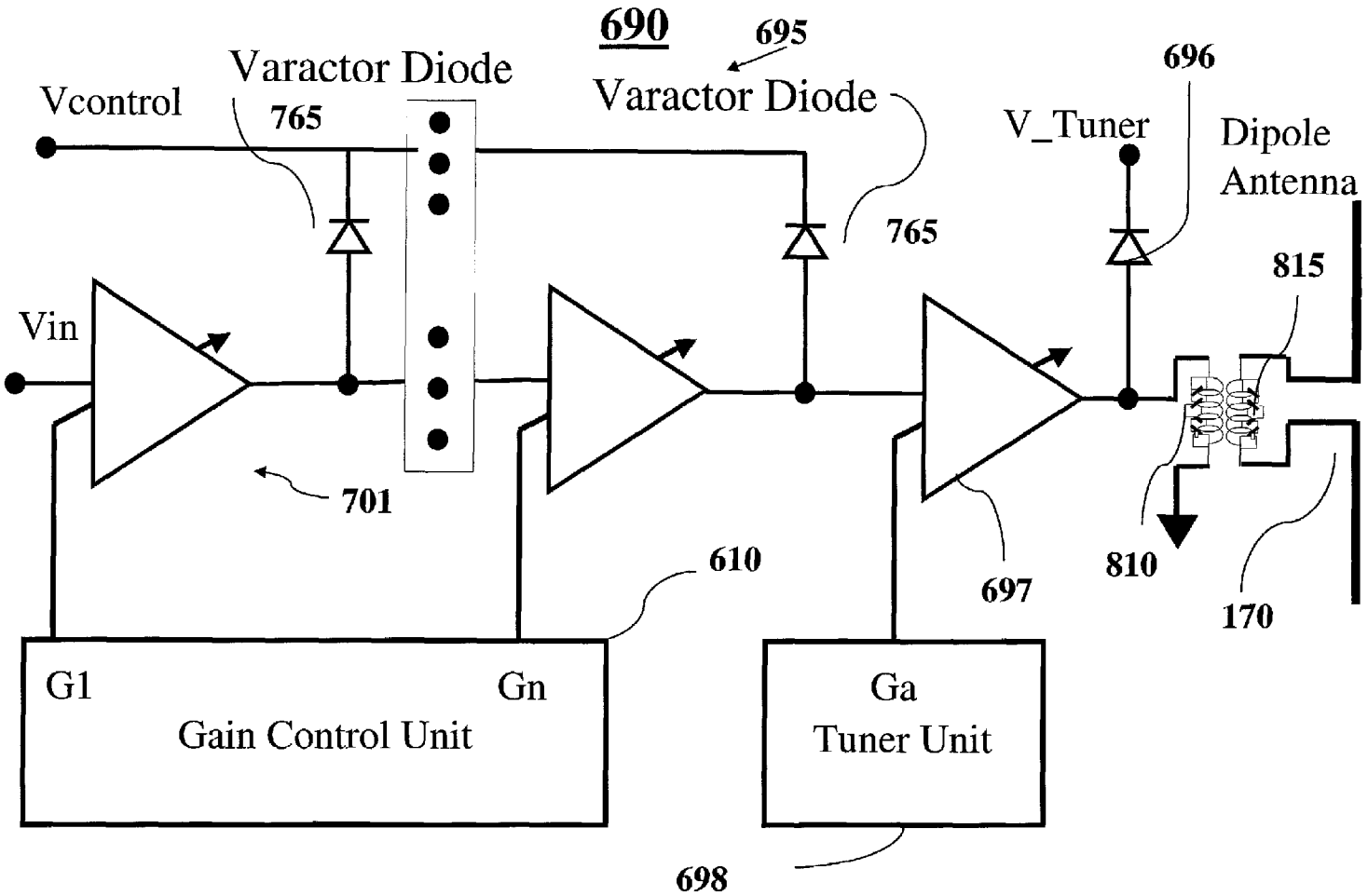
FIG. 6 is a block diagram of a single-ended integrated antenna circuit.

Turning now to FIG. 6, an integrated antenna circuit 690 is illustrated that includes a VCAPS phase shifter 695 having a plurality of n stages 701. A gain control unit 610 controls the bias signals so as to maintain a constant amplitude output signal despite changes in the control voltage Vcontrol. For example, gain control unit 610 may comprise a lookup table of appropriate gains based upon the control voltage. Although shown providing individual gain signals G1 through GN to the n stages 701, it will be appreciated that a common gain control signal may also be used. Phase shifter 695 drives a tuning circuit in a single ended fashion. In one embodiment, the tuning circuit comprises a varactor 696. Varactor 696 loads the single-ended output of phase shifter 695 that also drives dipole antenna 170. To provide isolation and transform from a single-ended to a differential drive signal, varactor 696 loads a coil 810 that forms a transformer with a coil 815 that drives dipole antenna 170. As will be explained further herein, a single-ended signal may inductively couple to a dipole so as to provide the appropriate double-ended (differential) drive signal. To provide additional matching of antenna 170 to the output of the phase shifter, the phase shifter may drive an additional variable amplifier 697 whose gain is controlled by a tuner unit 698. It will be appreciated that tuner unit 698 may be integrated with unit 610. An exemplary layout of integrated antenna circuits 690 on a wafer is illustrated in FIG. 1.

Figure 7:
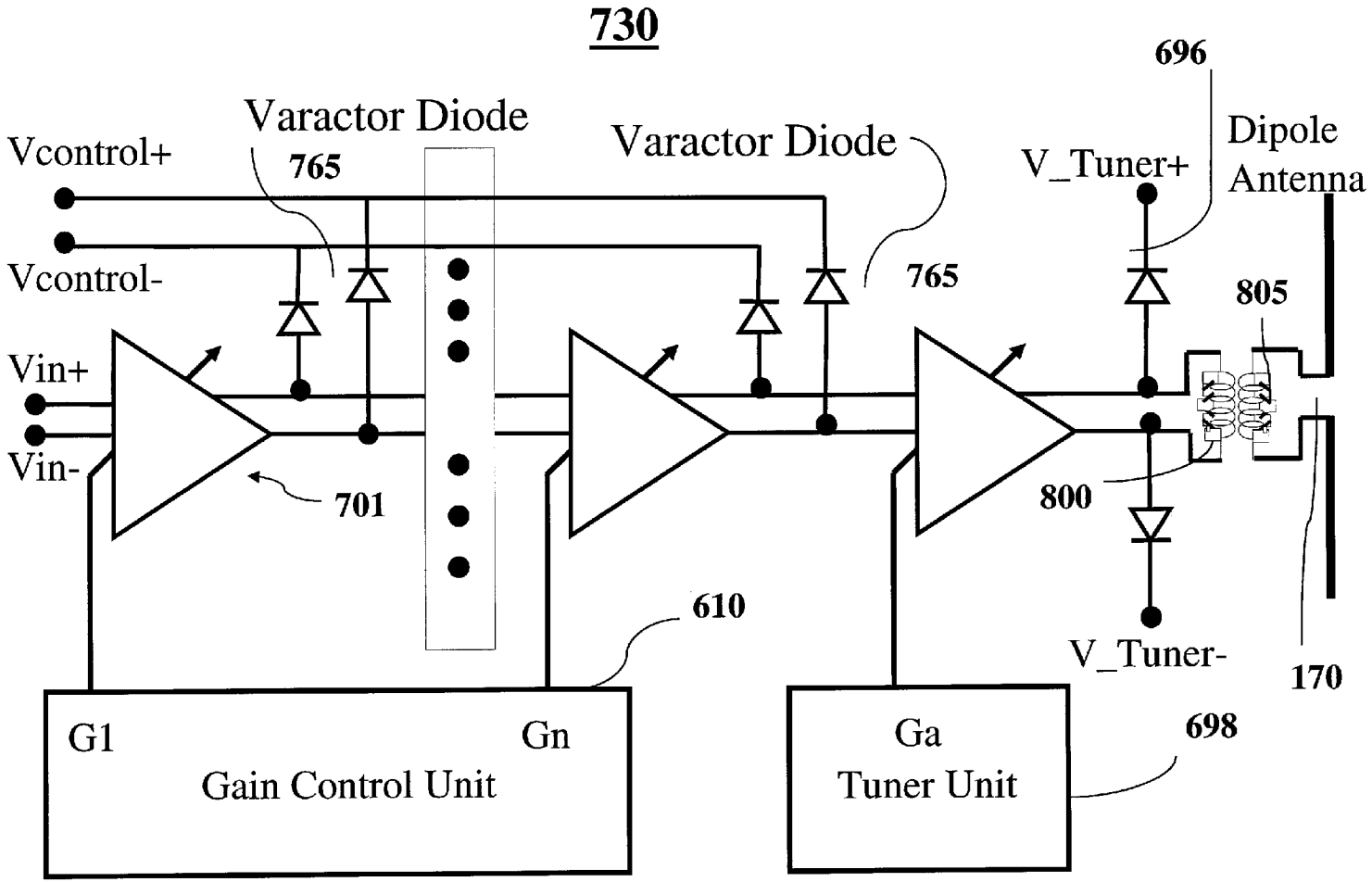
FIG. 7 is a block diagram of a differential integrated antenna circuit.
Figure 8A:
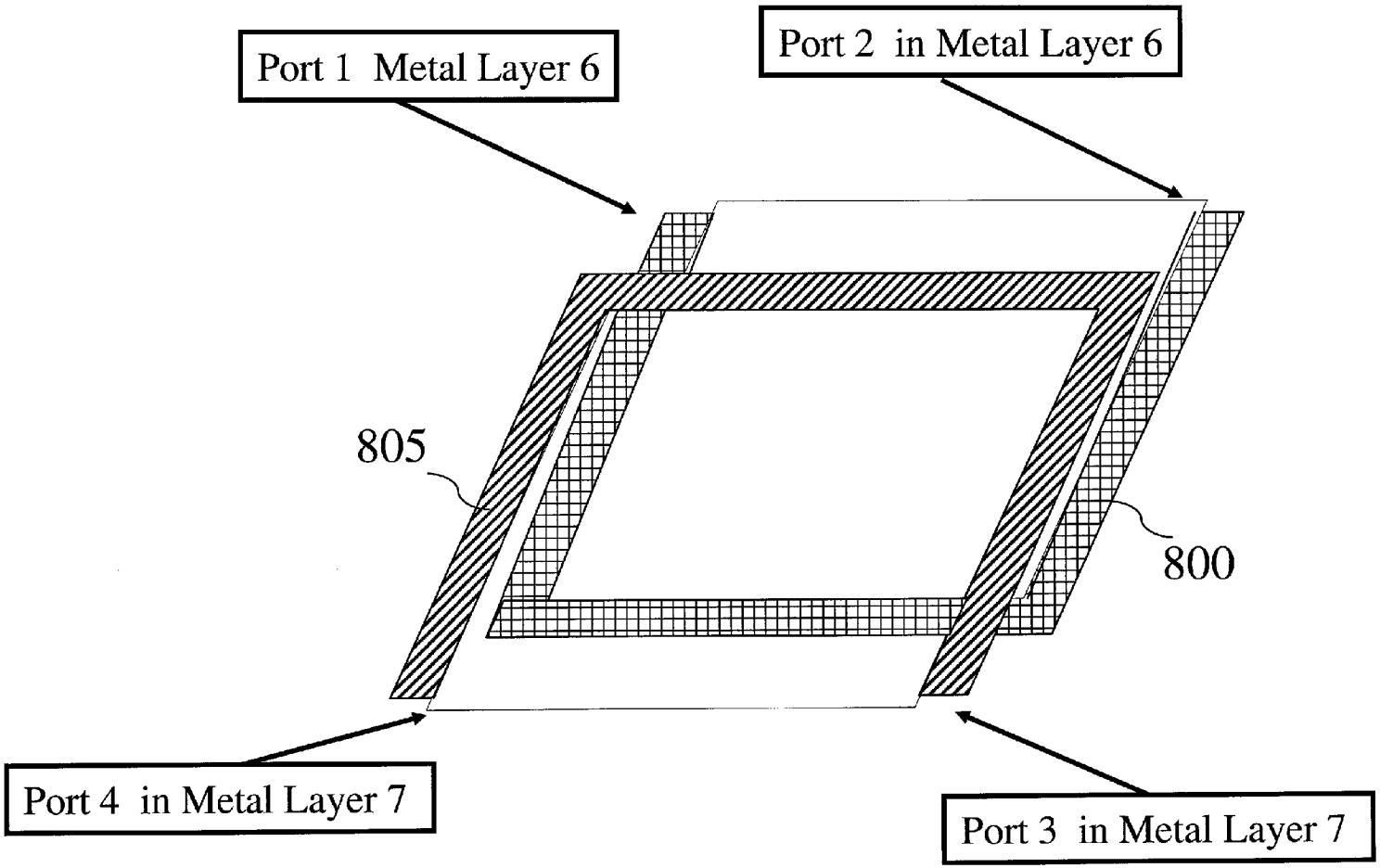
FIG. 8*a* is a schematic illustration of the transformer for the integrated antenna circuit of FIG. 7.
Figure 8B:
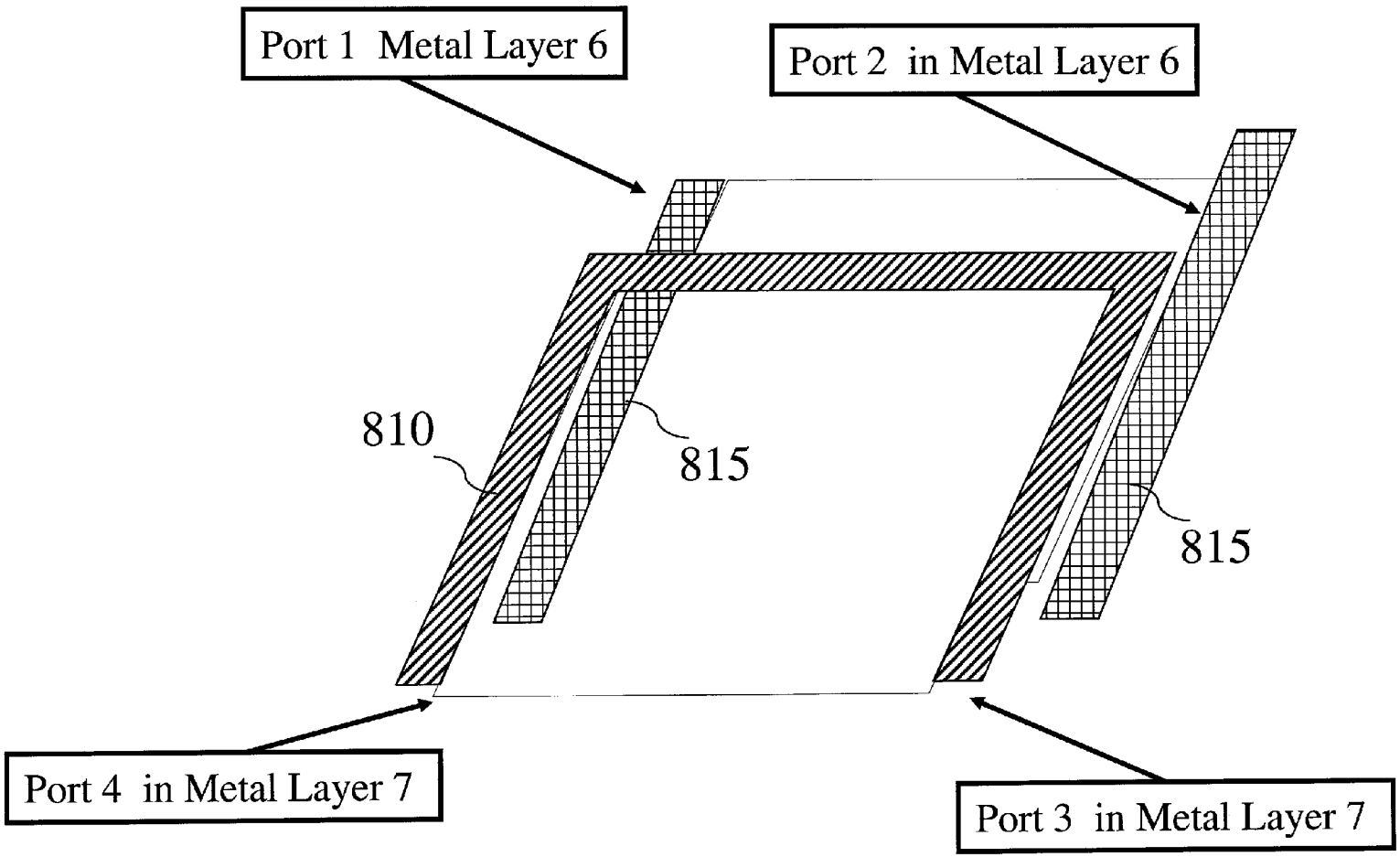
FIG. 8*b* is a schematic illustration of the transformer for the integrated antenna circuit of FIG. 6.

FIG. 7 illustrates an integrated antenna circuit 730 that is analogous to integrated antenna circuit 690 but modified for fully differential signaling. Thus, each stage 701 includes two varactor diodes 695 for loading its double-ended output nodes. Similarly, the tuning circuit includes two varactors 696 for loading the input nodes to a coil 800 that inductively couples to a coil 805 that drives dipole antenna 170. For example, FIG. 8*a* illustrates a differential inductive coupling formed through open coils 800 and 805. In one embodiment, coil 805 is formed in metal layer 7 whereas coil 805 is formed in metal layer 6. Referring back to FIG. 7, coil 805 drives antenna 170 through ports 3 and 4 whereas the remainder of the integrated antenna circuit drives coil 800 through ports 1 and 2. Coils 800 and 805 are open in that each coil does not complete a continuous 360 degree circumference. In other embodiments, each coil would form several such complete coils through the use of additional metal layers as discussed analogously in U.S. Pat. No. 6,963,307. Although complete coils provide more inductive coupling capability, open coils may be formed in a single metal layer and are thus more compact and less costly. In addition, the corresponding dipole antenna may then be formed in the same metal layer as used for coil 805. An analogous single-ended to differential inductive coupling is illustrated in FIG. 8*b* for coils 810 and 815 shown in FIG. 6. Coil 810 is formed in metal layer 7 and drives dipole antenna 170 through ports 3 and 4. Coil 815 is discontinuous in that it comprises parallel and separated conductor portions formed in metal layer 6 from ports 1 and 2. One of ports 1 and 2 is grounded and the remaining port driven with the single-ended input signal. It will be appreciated that because coil 815 is formed from parallel straight portions, it will couple both inductively and capacitively to coil 810. In other embodiments, port 1 and 2 may couple through a continuous coil.

Figure 9:
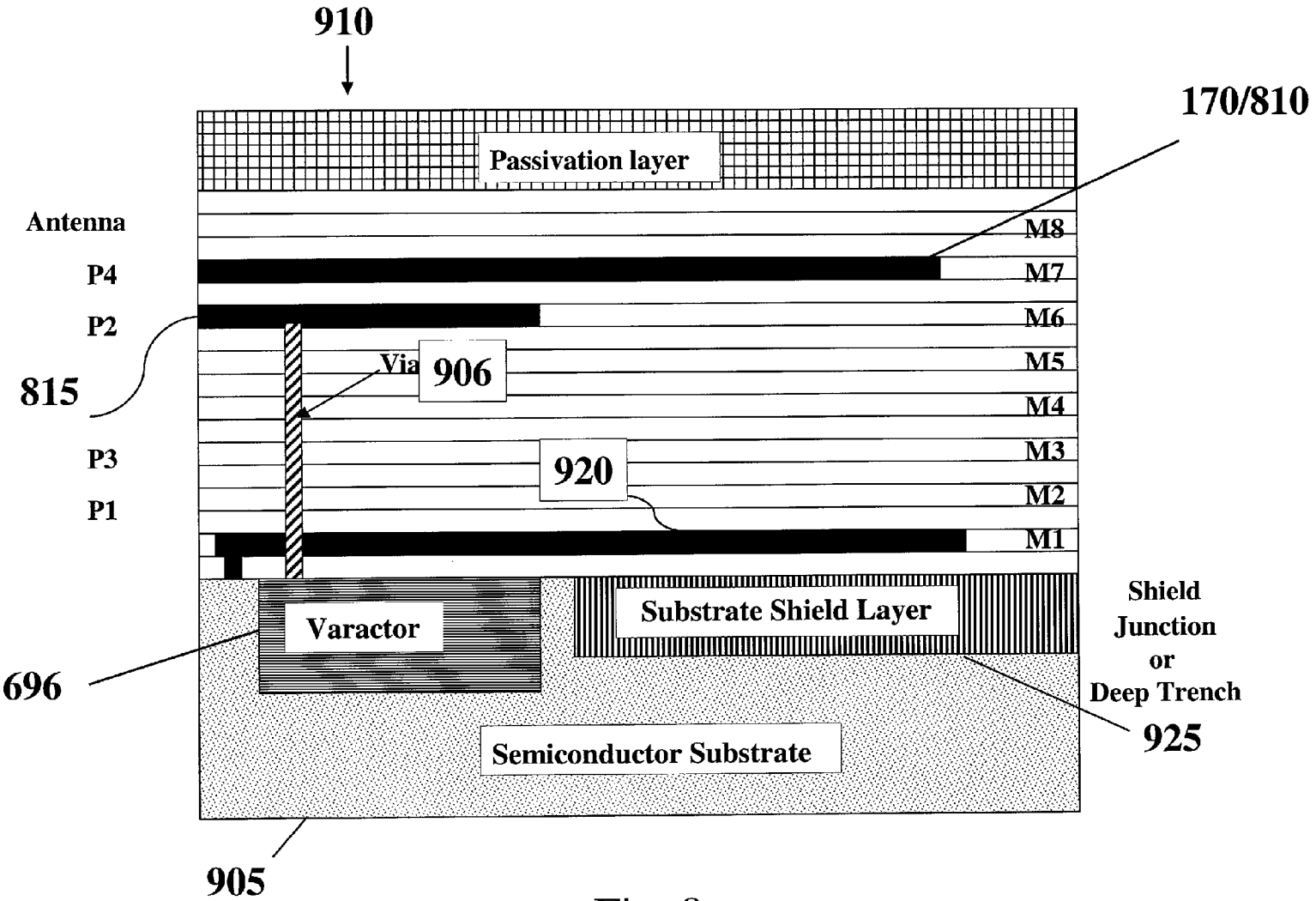
FIG. 9 is a cross-sectional view of the integrated antenna circuit of FIG. 6.

As discussed above, the transmission network and the antennas may be formed in metal layers on opposing sides of the substrate or on the same side of the substrate. The latter approach is illustrated in FIG. 9 with regard to the coupling of varactor 696 to coil 815. Varactor 696 is integrated with a semiconductor substrate 905. In addition, other active circuitry (not illustrated) such as the phase shifter and the distributed amplifiers in the resonant transmission network are also integrated into substrate 905. Varactor 696 couples through a contact to a via 906 so as to drive coil 815 that in turn couples to coil 810 so as to drive antenna 170. A passivation layer 910 protects the antennas and couples them to free space. To minimize coupling of the antenna to the substrate, a grounded shield layer 920 may be formed in a suitable metal layer such as metal layer 1 (M1). Additional shielding may be provided by a doping a conductive shield layer 925 into substrate 905. The metal layers would also be used to form the CPW network for the resonant transmission network analogously as discussed in U.S. application Ser. No. 11/555,210, filed Oct. 31, 2006, the contents of which are incorporated by reference.

Figure 10:
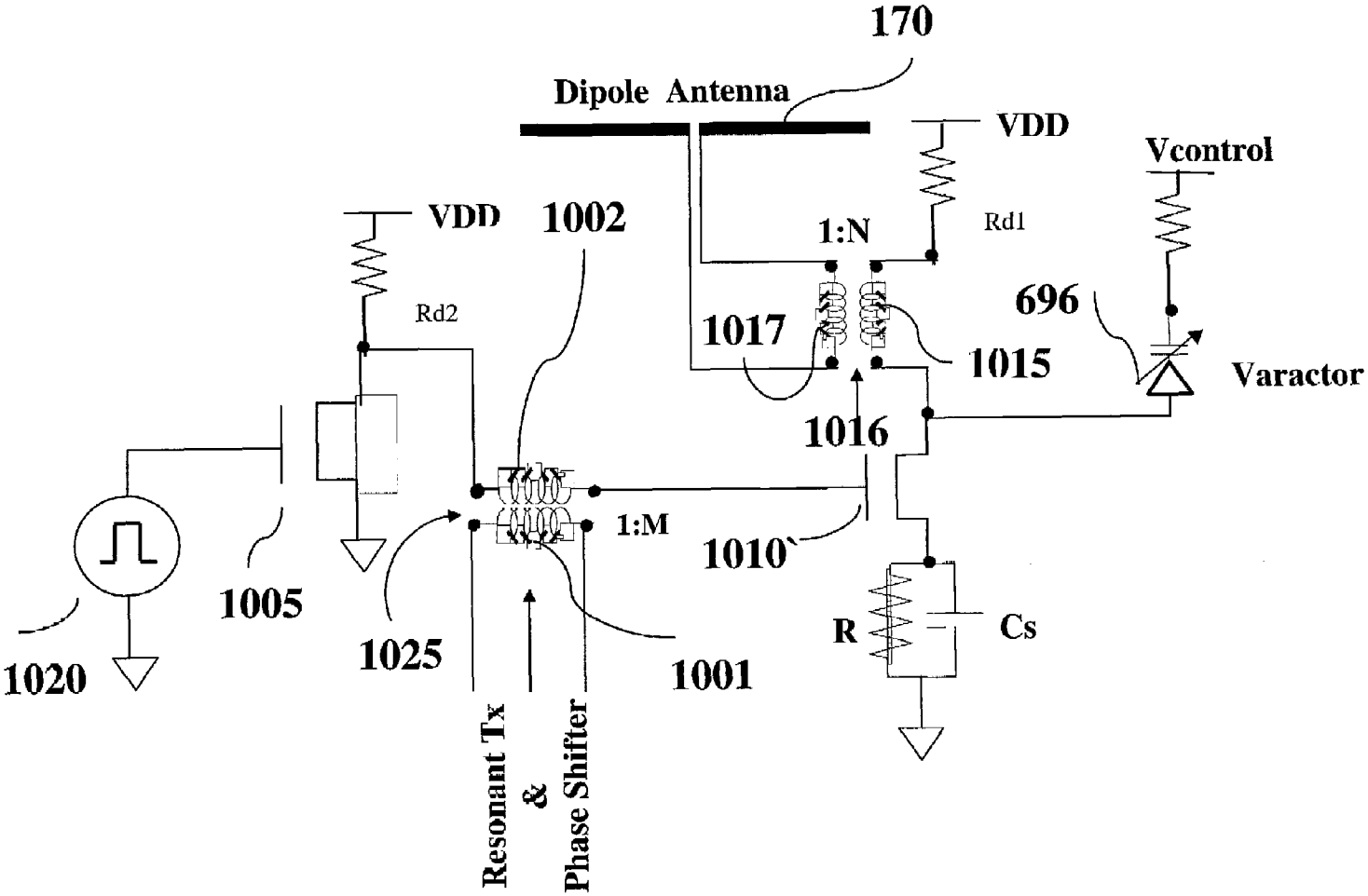
FIG. 10 is a schematic illustration of part of an integrated antenna circuit modified for use in a radar transmitter.

Advantageously, the resulting dipole antennas are compatible with conventional semiconductor manufacturing processes such as CMOS BiCMOS, or FET. In one embodiment, the tunable dipoles may be used to form a radar transmitter 1000 as illustrated in FIG. 10. An RF signal is provided by, for example, the resonant transmission network discussed earlier and phase shifted through, for example, the VCAPS phase shifter also discussed earlier. This RF signal drives a coil 1001 in a transformer 1025. A transistor 1005 controls whether a remaining coil 1002 in transformer 1025 can conduct responsive to cycles of a gating signal 1020. Coil 1002 drives a gate of a transistor 1010 whose source is loaded by a capacitor Cs and a resistor R. Varactor 696 loads the drain of transistor 1010, which is also loaded by a coil 1015 of a transformer 1016. A remaining coil of transformer 1016 drives dipole 170. It will thus be appreciated that gating signal 1020 gates pulses of RF through transformer 1025 and 1016 as loaded by varactor 696. Not only is the resulting radar transmitter compatible with conventional semiconductor manufacturing processes but it also provides beamforming capabilities.

Referring again to FIG. 1, a receiving CPW network may be formed analogously as shown for network 410. This receiving CPW network may incorporate linear distributed amplification and phase shifting as discussed, for example, in U.S. application Ser. No. 11/535,928. Depending upon the pulse width of the gating signal 120, a certain number n of range bins may be detected. The resulting n channels may then be formed from a received signal at an output port analogous to input port 405. In that regard, correlation and integration and dump processing may be performed externally to the integrated circuit or may be integrated therewith. In an alternative embodiment, each integrated antenna circuit may include its own correlation and integration and dump processing circuit such that each integrated antenna circuit includes its own version of the n channels/time bins for processing. Such an embodiment would not have the dispersion introduced by propagation through a CPW receiving network. However, dispersion is not problematic through a receiving network because detection for any given time bin is based upon a peak signal level and is thus not that sensitive to spreading of rising and falling times for the received pulses.

Although the tunable dipole antennas discussed herein have been described with respect to particular embodiments, this description is only an example of certain applications and should not be taken as a limitation. For example, the granularity of the phase shifters may be varied as discussed in U.S. patent application Ser. No. 11/555,210 and need not be on a one-to-one basis with the tuning circuits and dipole antennas. Moreover, the use of the resonant transmission network need not be to supply the RF carrier to the antennas. Instead, the globally synchronized RF signal from the resonant transmission network may be used at the integrated antenna circuits to modulate a carrier signal. Consequently, the scope of the claimed subject matter is set forth as follows.

I claim:

1. An integrated circuit, comprising:

a substrate, a plurality of dipoles adjacent the substrate;

an RF feed network adjacent the substrate and coupled to drive a plurality of output nodes with an RF signal; and a plurality of tuning circuits corresponding to the plurality of dipoles, each tuning circuit configured to load an RF signal from a corresponding one of the output nodes with a variable capacitance responsive to a control signal, the loaded RF signal driving the dipole antenna corresponding to the tuning circuit.

2. The integrated circuit of claim 1, further comprising a plurality of phase shifters corresponding to the plurality of output nodes, each phase shifter operable to variably phase shift the RF signal at its output node.

3. The integrated circuit of claim 2, further comprising a distributed plurality of amplifiers integrated with the substrate, wherein the RF feed network and the distributed plurality of amplifiers are configured to form a resonant network such that if a timing signal is injected into an input port of the RF feed network, the resonant network oscillates to globally synchronize the RF signal provided to the plurality of output nodes.

4. The integrated circuit of claim 2, wherein each phase shifter comprises:

a plurality of stages, wherein each stage includes:

a transistor amplifier configured to amplify the globally synchronized RF signal received at an input node into an amplified voltage signal at an output node according to a gain, wherein the transistor amplifier is configured such that the gain is proportional to a bias signal;

an integrated inductor loading the output node, wherein the gain of the transistor amplifier is also proportional to an inductance of the integrated inductor; and a varactor diode loading the output node, wherein the varactor diode has a variable capacitance responsive to a control voltage such that a phase-shifted version of the globally synchronized signal is produced at the output node.

5. The integrated circuit of claim 1, wherein the substrate is a semiconductor wafer substrate.

6. The integrated circuit of claim 1, wherein the RF feed network is implemented using waveguides selected from the group consisting of microstrip waveguides, co-planar waveguides, and planar waveguides.

7. The integrated circuit of claim 1, wherein the antennas are formed in metal layers adjacent a first surface of the substrate and wherein the RF feed network is a co-planar waveguide network also formed in the metal layers adjacent the first surface of the substrate.

8. The integrated circuit of claim 1, wherein the antennas are formed in metal layers adjacent a first surface of the substrate and wherein the RF feed network is a co-planar waveguide network formed in metal layers adjacent an opposing surface of the substrate.

9. The integrated circuit of claim 1, further comprising:

a gating circuit to gate the RF signal provided to each dipole antenna such that the dipole antennas are operable to transmit gated pulses of RF signals.

10. A method, comprising:

driving a resonant network of distributed oscillators to produce an globally synchronized output signal at a plurality of output nodes;

loading the plurality of output nodes with a variable capacitance to match the resonant network to a corresponding plurality of dipole antennas; and transmitting the globally synchronized output signal from the plurality of loaded output nodes through the corresponding plurality of dipole antennas.

11. The method of claim 10, wherein loading the plurality of output nodes comprises loading the plurality of output nodes with a variable capacitance from a varactor responsive to a control signal.

12. An integrated circuit, comprising:

a substrate, a plurality of dipole antennas adjacent a first side of the substrate; and an RF feed network adjacent a second side of the substrate, the RF feed network coupling to a distributed plurality of amplifiers integrated with the substrate, wherein the RF feed network and the distributed plurality of amplifiers are configured to form a resonant network such that if a timing signal is injected into an input port of the RF feed network, the resonant network oscillates to provide a globally synchronized RF signal to a plurality of integrated antenna circuits, wherein each integrated antenna circuit includes a corresponding subset of dipole antennas, and wherein each integrated antenna circuit includes a phase shifter to phase shift the globally synchronized RF signal to provide a phase-shifted signal to a tuning circuit that in turn provides a loaded signal to the integrated antenna circuit's dipole antenna, the tuning circuit loading the loaded signal with a variable capacitance so as to match its dipole antenna to the RF feed network.

13. The integrated circuit of claim 12, wherein the substrate is a semiconductor wafer substrate.

14. The integrated circuit of claim 12, wherein the RF feed network is implemented using waveguides selected from the group consisting of microstrip waveguides, co-planar waveguides, and planar waveguides.

15. The integrated circuit of claim 14, wherein the RF feed network is implemented using coplanar waveguides.

* * * * *

UNITED STATES PATENT AND TRADEMARK OFFICE

CERTIFICATE OF CORRECTION

PATENT NO. : 7,542,005 B2
APPLICATION NO. : 11/567650
DATED : June 2, 2009
INVENTOR(S) : Farrokh Mohamadi It is certified that error appears in the above-identified patent and that said Letters Patent is hereby corrected as shown below:

On the Title page, item 63 Insert

--Related U.S. Application Data--

--Continuation-in-part of application No. 11/536,625, filed on Sep. 28, 2006, which is a continuation-in-part of application No. 11/182,344, filed on Jul. 15, 2005, which is a continuation-in-part of application No. 11/141,283, filed on May 31, 2005.--

--Provisional application No. 60/721,204, filed on Sep. 28, 2005.--

Signed and Sealed this

Fifteenth Day of September, 2009

David J. Kappos

David J. Kappos
*Director of the United States Patent and Trademark Office*